US006289768B1

(12) United States Patent
Anderson et al.

(10) Patent No.: US 6,289,768 B1
(45) Date of Patent: Sep. 18, 2001

(54) MULTIPURPOSE FOLDING TOOL INCLUDING CORKSCREW

(75) Inventors: Craig J. Anderson, Gresham; Benjamin C. Rivera, West Linn, both of OR (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 09/240,372

(22) Filed: Jan. 29, 1999

(51) Int. Cl.[7] ..... B67B 7/04; B25B 7/22

(52) U.S. Cl. ..... 81/3.09; 81/3.35; 81/3.45; 7/128; 7/155

(58) Field of Search ..... 81/3.48, 3.09, 81/3.36, 3.29, 3.55, 3.47, 3.57, 3.35, 3.45; 7/127–129, 132, 151–152, 154–156; 30/429, 409, 435, 450

(56) References Cited

U.S. PATENT DOCUMENTS

| | | | | |
|---|---|---|---|---|
| D. 406,025 | * | 2/1999 | Hung | 81/3.09 X |
| 456,811 | * | 7/1891 | Gerlach | 7/156 X |
| 522,672 | * | 7/1894 | Puddefoot | 81/3.35 |
| 637,048 | | 11/1899 | Toulotte . | |
| 786,492 | | 4/1905 | Garimaldi . | |
| 898,387 | * | 9/1908 | Noyes | 81/3.35 |
| 899,407 | * | 9/1908 | Kampfe | 81/3.09 X |
| 1,194,296 | | 8/1916 | Jones et al. . | |
| 1,339,164 | * | 5/1920 | Clough | 7/155 X |
| 1,811,982 | * | 6/1931 | Soustre | 7/142 X |
| 2,578,983 | | 12/1951 | Primak | 30/22 |
| 4,437,359 | | 3/1984 | Dejoux et al. | 81/3.38 |
| 4,584,911 | | 4/1986 | Cellini | 81/3.36 |
| 4,759,238 | | 7/1988 | Farfalli | 81/3.09 |
| 4,888,869 | | 12/1989 | Leatherman | 30/161 |
| 4,996,895 | | 3/1991 | Puig | 81/3.09 |
| 5,363,725 | | 11/1994 | Cellini | 81/3.09 |
| 5,454,282 | | 10/1995 | Del Mistro | 81/3.48 |
| 5,826,338 | | 10/1998 | Chilton et al. | 30/90.1 |
| 5,829,965 | | 11/1998 | Rubalcava | 431/253 |
| 5,862,720 | * | 1/1999 | McNellis | 81/3.09 |

FOREIGN PATENT DOCUMENTS

| | | |
|---|---|---|
| G 94 06 989.1 | 4/1994 | (DE) . |
| 0 513 937 A2 | 4/1987 | (EP) . |
| 725.652 | 10/1931 | (FR) . |
| 1.072.970 | 3/1954 | (FR) . |
| 2 655 635 | 12/1989 | (FR) . |
| 2 760 955 | 3/1997 | (FR) . |
| WO 97/19787 | 6/1997 | (WO) . |
| WO 98/18599 | 5/1998 | (WO) . |

OTHER PUBLICATIONS

The Original Leatherman PCT II™At least as early as 1995. At least as early as 1995.

* cited by examiner

*Primary Examiner*—D. S. Meislin
(74) *Attorney, Agent, or Firm*—Chernoff, Vilhauer, McClung & Stenzel, LLP

(57) ABSTRACT

A multipurpose folding tool, for use by picnickers and travelers, including a corkscrew, a crown cap remover, and a can opener, as well as a small fork and a small butter knife. Both the corkscrew and a brace for use together with it fit close to the handles of the tool when the tool is in a compact, folded configuration. A spring in one handle keeps the corkscrew safely folded when not in use, and a spring on the brace keeps it in a desired position relative to the handles. The tool also includes folding pliers and may include folding screwdrivers, knife blades, and scissors.

25 Claims, 5 Drawing Sheets

MULTIPURPOSE FOLDING TOOL INCLUDING CORKSCREW

BACKGROUND OF THE INVENTION

The present invention relates to multipurpose folding tools, and in particular to such a tool incorporating a corkscrew and other tools useful in connection with packaged foods.

Corkscrews, bottle openers, and can openers of various types have been known for many years and long have been included in multipurpose folding tools. More recently, multipurpose folding tools including pliers, as well as various other tool blades and bits, have been available, as disclosed, for example, in Berg et al. U.S. Pat. No. 5,745,997.

Some previously available tools including corkscrews have either had very limited capabilities with respect to tasks other than opening bottles, or else have been undesirably bulky and heavy to carry in view of the tasks which such tools have been capable of performing. Other previously available tools including corkscrews have been incapable of being folded into a compact configuration free from sharp edges or elements which could become snagged in the pocket of a person carrying such tools.

What is desired, then, is an improved multipurpose folding tool that includes a corkscrew, which can be placed into a compact configuration, and which functions conveniently and adequately to remove corks from bottles, to remove crown caps from bottles, and to open cans having metal lids attached by crimped rims. Such a multipurpose folding tool should also be capable of performing other routine tasks common to small hand tools.

SUMMARY OF THE INVENTION

The present invention provides a multipurpose folding tool which overcomes the previously-mentioned shortcomings and the disadvantages of some previously-known multipurpose tools by providing a multipurpose folding tool incorporating a corkscrew housed in a handle of such a tool in a location making the corkscrew readily available for use, together with a brace for use together with the corkscrew to provide necessary leverage to remove a cork from a bottle neck.

As one aspect of the present invention, a multipurpose folding tool includes at least one handle housing a tool blade which is movable with respect to the handle about a pivot, between an extended position and a folded position within the handle, a corkscrew attached to the handle and movable with respect to the handle about a pivot, between respective folded and operative positions, and a spring located within the handle and extending to the base of the corkscrew to hold the corkscrew in place in its folded position.

In one preferred embodiment of such a tool a folding brace for use with the corkscrew is attached to the handle by a pivot connection spaced apart from the pivot connection to which the corkscrew base is attached, and such a brace is movable between an extended position and a folded position extending along the handle.

As another aspect of the present invention, a combined bottle opener and can opener in the form of a channel-shaped member is attached to the handle of a multipurpose folding tool by a pivot and includes a pair of sides, one of which includes a hook and a can-piercing point, while the other side includes another hook and a rocker located so that both hooks can be used to engage a crown cap to remove it from a bottle.

In one embodiment of the invention the combined bottle opener and can opener incorporates a spring which follows a cam to limit the movement of the opener in connection with use of the can opener or bottle opener features of the invention.

In one embodiment of the invention, a spring mounted in the multipurpose folding tool's handle includes a base incorporating such a cam.

As a third aspect of the invention, a handle for a multipurpose folding tool defines an opening extending longitudinally along an angle portion defined where a side of the handle meets the back of the handle, and a corkscrew is attached to the side of the handle by a pivot connection so that it is rotatable, between an extended position and a folded position in which the corkscrew is located partly in the opening and extends partly within the handle.

In a preferred embodiment of that aspect of the invention a brace is also attached to such a handle and is rotatable between a folded position close to the handle and an extended position in which it aids in use of the corkscrew.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENT

Figure 1:
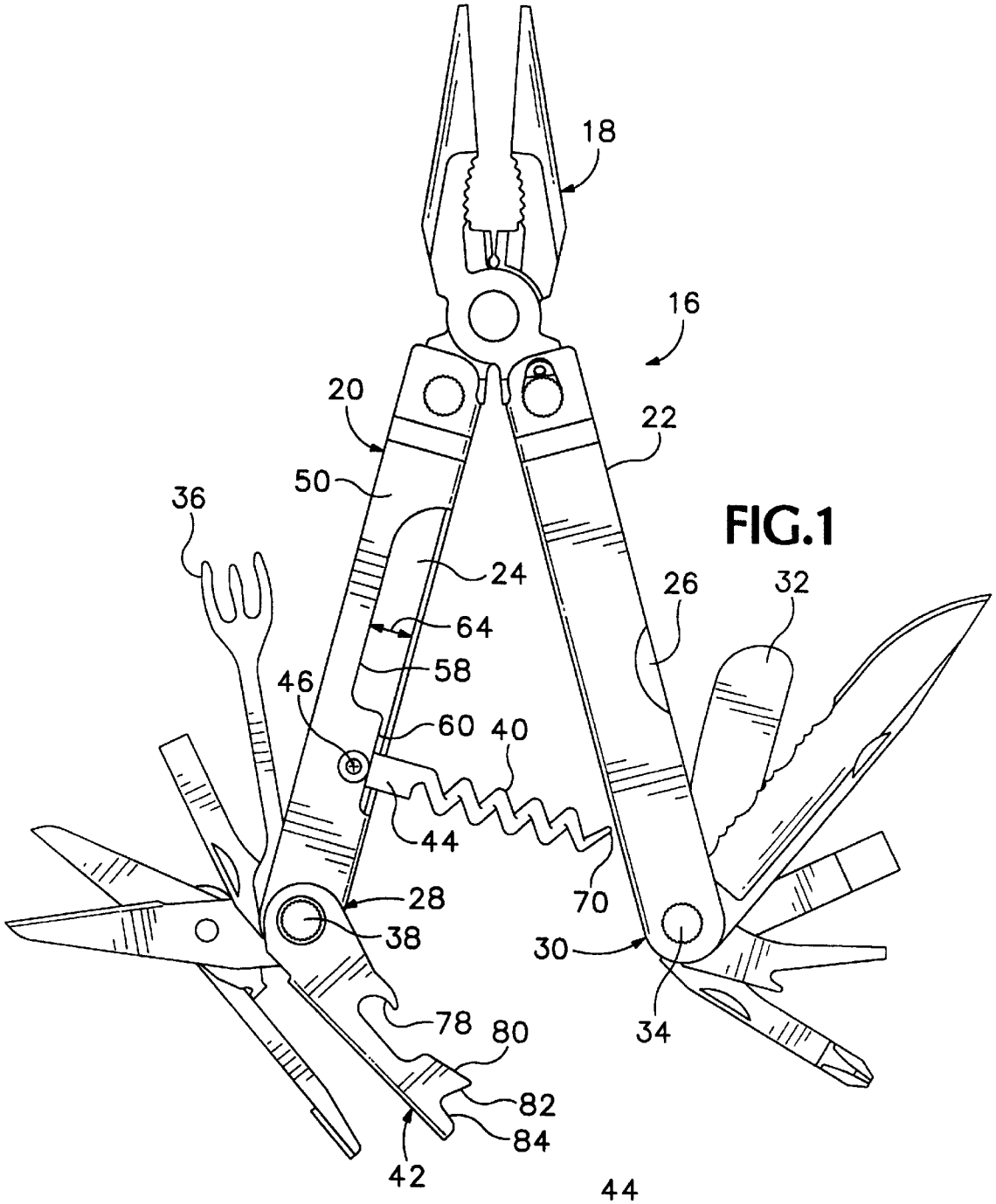
FIG. 1 is an elevational view of a multipurpose folding tool embodying the present invention, in a fully unfolded configuration.

Referring now to the drawings which form a part of the disclosure herein, a multipurpose folding tool 16 is shown in FIG. 1 in a fully unfolded configuration for the sake of showing each of the several folding blades and tools which are included in one exemplary embodiment of the present invention. The folding multipurpose tool 16 includes a pair of pliers 18 equipped with channel-shaped handles 20 and 22 that can be folded. That is, the inner ends of the handles 20 and 22 are attached to the pliers by pivots and can be rotated around the pliers' jaws to house them within cavities 24 and 26 defined, respectively, by the handles 20 and 22.

A plurality of other tools are mounted in the handles 20 and 22 at the opposite, outer ends 28 and 30 thereof, spaced apart from the pliers 18. Tool blades including a knife 32, such as a butter or paté knife, a sharp-edged knife, and three screwdriver bits are all mounted for rotation independently about a pivot shaft 34 in the handle 22, between a folded position for storage within the cavity 26 and an extended position with respect to the handle 22. Similarly, a tool blade such as a small fork 36 is mounted rotatably on a pivot shaft 38, alongside another screwdriver blade and a folding scissors, all of which can be moved independently about a pivot axis defined by the pivot shaft 38, between a folded position within the cavity 24 and an extended position with respect to the handle 20. With all of those tools folded, room still remains for the pliers 18 also to be enclosed within the cavities 24 and 26, with the open sides of the channel-shaped handles facing toward each other.

A corkscrew 40 and a corkscrew brace member 42 are attached to the handle 20. The corkscrew 40, shown in an extended position in FIG. 1, has a flat, elongate base portion 44 that is attached to the handle 20 by a pivot connection, which may include a rivet, defining a pivot axis 46 about which the corkscrew 40 is moveable through an angle greater than 90°. The brace 42 is attached to the handle by the pivot shaft 38 and may be rotated with respect to the handle 20 about the pivot shaft 38.

Figure 2A:
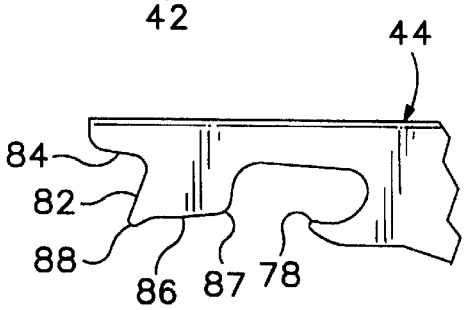
FIG. 2*a* is a detail view of a portion of a corkscrew brace showing an alternative embodiment of one aspect of the invention.
Figure 2:
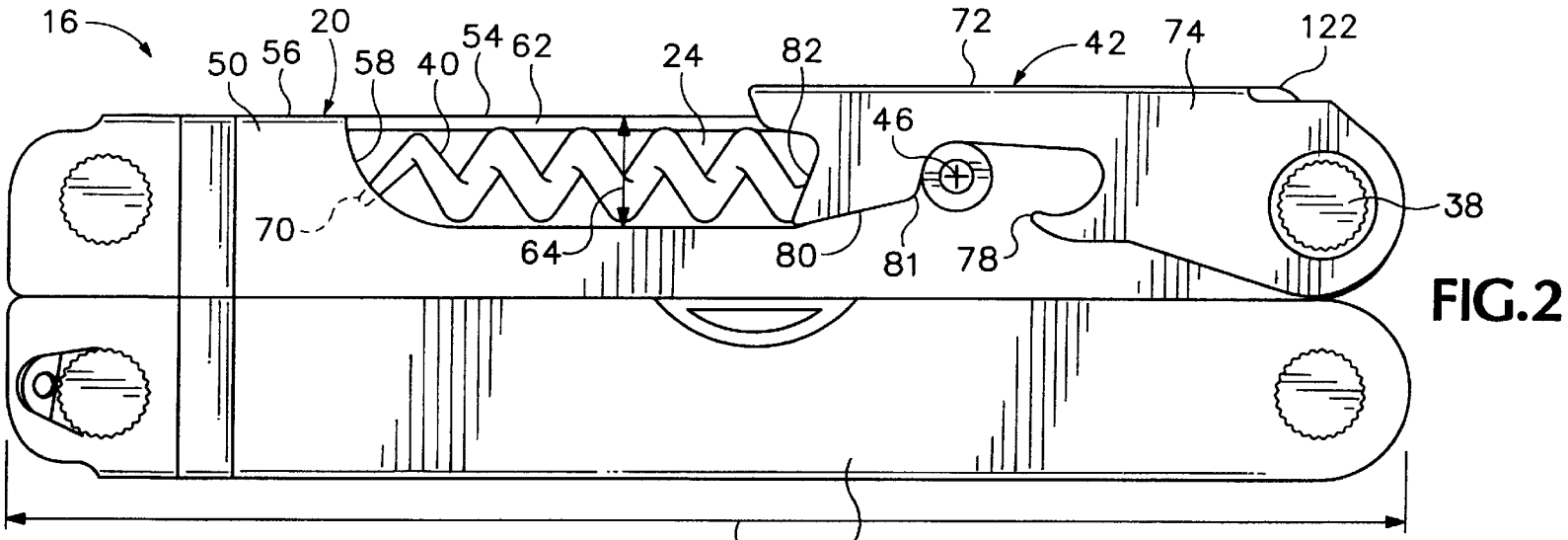
FIG. 2 is a left side elevational view of the tool shown in FIG. 1, in a fully-folded configuration.
Figure 3:
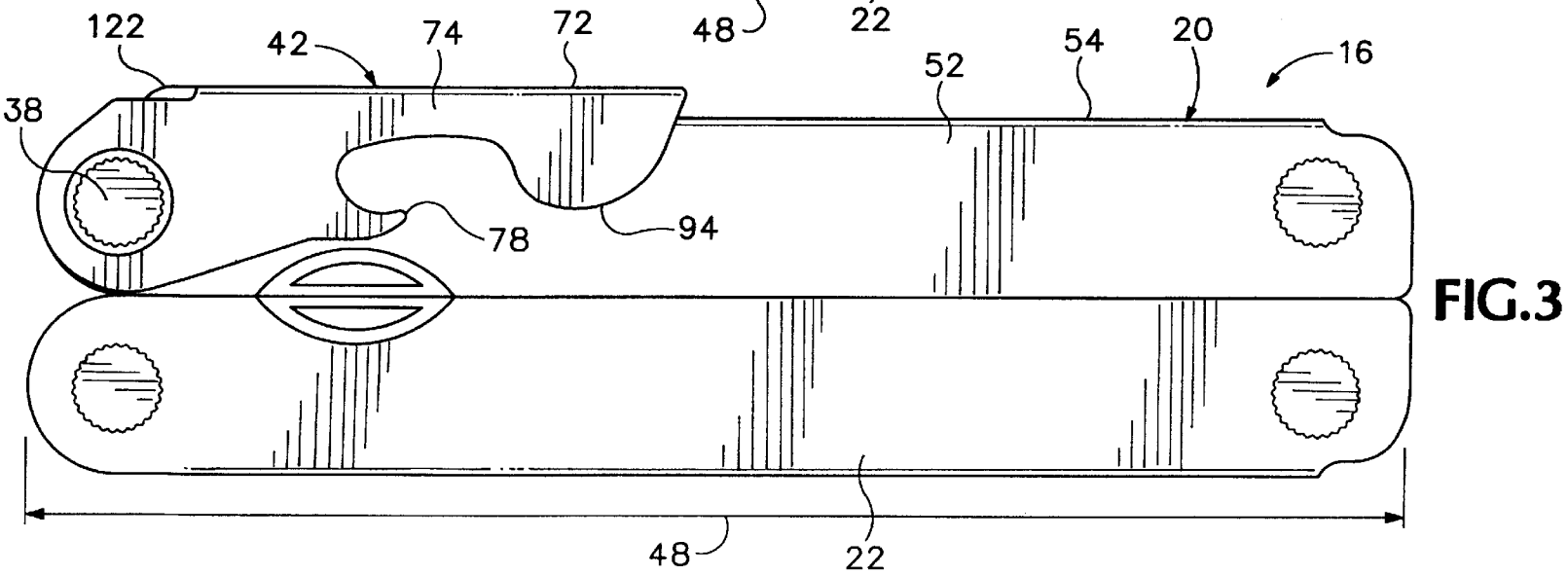
FIG. 3 is a right side elevational view of the tool shown in FIG. 1, in its fully-folded configuration.
Figure 4:
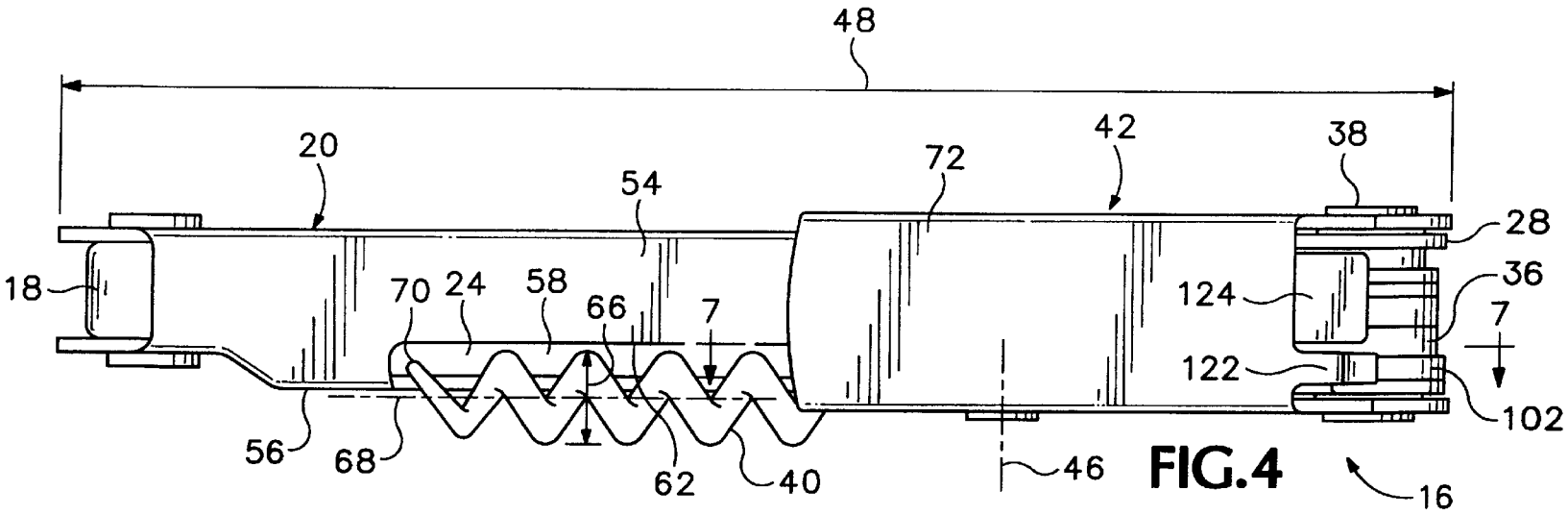
FIG. 4 is a top plan view of the multipurpose folding tool shown in FIGS. 1–3, in its fully-folded configuration.

As shown in FIGS. 2, 3 and 4, the folding multipurpose tool 16 has a compact configuration in which the pliers 18 and the several blades and tool bits, including the knife 32 and the fork 36, are in respective folded positions and enclosed within the cavities 24 and 26. At the same time, the corkscrew 40 and the brace 42 are in folded positions parallel with the length 48 of the handle 20.

The handle 20 may be made, for example, by bending sheet metal, and includes a first side 50, a second side 52, and a back 54, together defining the generally U-shaped channel form of the handle 20. The first side 50 and the back 54 are connected with each other along a fold or angle 56 extending longitudinally of the handle 20, and an opening 58 extending along the angle 56 is defined partially by the back and partially by the first side 50. The opening 58 is defined by a straight margin 62 of the back 54, and a rear portion 60 of the opening 58 is narrower than the forward portion of the opening.

In the rear portion 60 of the opening 58, the first side 50 is cut away only as far down as the bottom or inner surface of the back 54, but in the forward portion of the opening 58 the first side 50 is cut away to a greater distance 64 downward from the angle 56.

Figure 5:
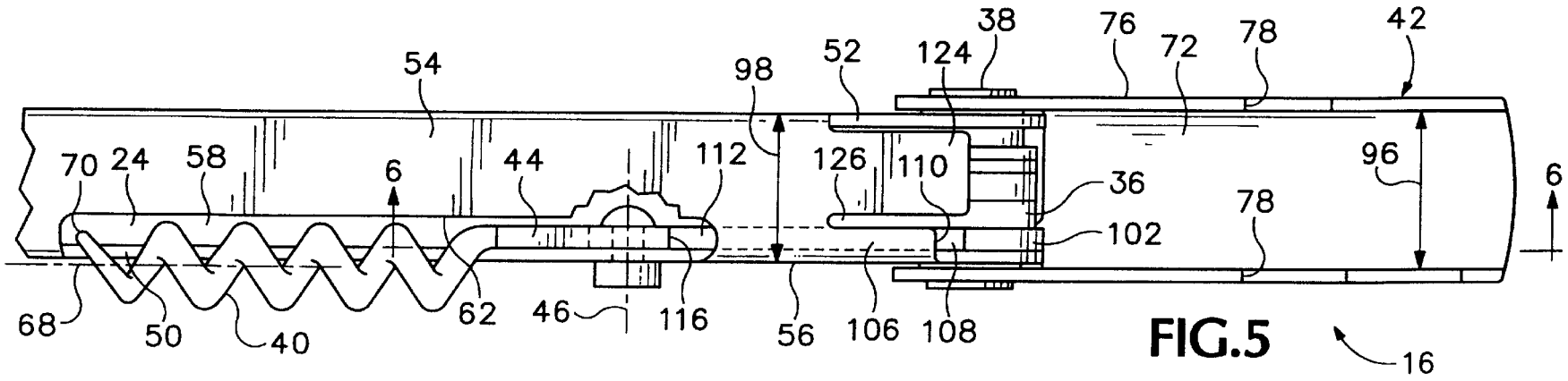
FIG. 5 is a top plan view of a portion of the tool, with a combination can opener and bottle opener in a fully-extended position.

The corkscrew 40 includes a worm portion having a diameter 66 and defining a central longitudinal axis 68. When the corkscrew 40 is in its folded position as shown in FIGS. 2, 4 and 5, none of the worm portion extends outward (upward in FIG. 2) beyond the back 54 of the handle 20, as the distance 64 is greater than the diameter 66 and the location of the pivot axis 46 places the central longitudinal axis 68 well below the back 54. The central longitudinal axis 68 is located outside the cavity 24, however, it is spaced laterally a small distance outside the first side 50 of the handle. A tip 70 of the corkscrew 40 is located within the cavity 24 where it is prevented from accidentally snagging something such as the fabric of a pocket in which the tool 16 is being carried.

The brace 42, like the handle 20, is in the form of a channel, and has a central back portion 72, a first, or can opener side 74, and an opposite second side 76. Each of the sides 74 and 76 defines a respective bore receiving the pivot shaft 38 and defining a pivot axis about which the brace 42 can be rotated between its folded position and a range of extended positions in which it is used. Spaced forward along the brace 42 from the bores are a pair of forwardly open hooks 78 defined by the sides 74 and 76. On the first side 74, a short, straight can opener blade 80 is located a short distance ahead of the hook 78, and has an arcuate rear end 81. At a forward end of the can opener blade 80 a forward-facing surface of the first side 74 defines a foot 82. A heel portion 84 extends beyond the foot to the front end of the back portion 42.

As shown in FIG. 2i a, a can opener blade 86, an alternative to the form of the straight can opener blade 80, has a rear end 87 and a piercing tip 88 protruding slightly with respect to a more rearwardly located part of the blade 86, in order to provide more concentrated pressure with the tip 88 to pierce a can lid to begin the process of opening a can in the manner that will be described presently.

Figure 6:
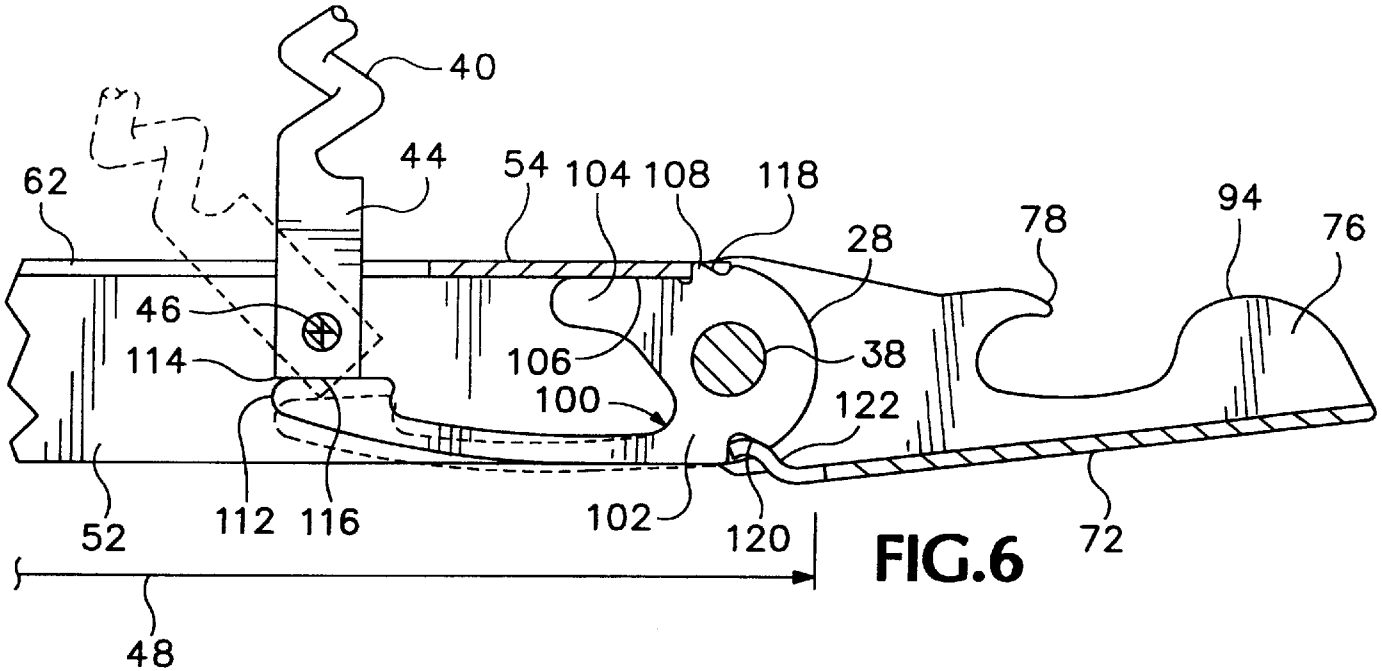
FIG. 6 is a section view, taken along line 6—6 in FIG. 5.

Ahead of the hook 78 on the second side 76 of the brace 42, instead of the can opener blade 80, there is a rocker 94, whose profile is shown clearly in FIGS. 3 and 6. The rocker 94 is aligned, laterally with respect to the brace 42, with the can opener blade 80, and the two hooks 78 on the respective sides 74 and 76 are similarly aligned with each other.

As may be seen in FIG. 5, the brace 42 has an inside width 96 which is only slightly greater than the outside width 98 of the handle 20, so that the brace 42 is nested closely around the back 54 and sides 50 and 52 of the handle 20 when the brace 42 is in its folded position as shown in FIGS. 2–4. As a result, the first side 74 of the brace 42, and the foot 82, are aligned with the central longitudinal axis 68 of the corkscrew 40. Additionally, because the first side 74 is oriented perpendicular to the pivot shaft 38, and the longitudinal axis 68 of the corkscrew 40 is perpendicular to the pivot axis 46, the foot 82 always remains in the imaginary plane defined by the longitudinal axis 68 as the corkscrew 40 is moved through an angle about the pivot axis 46, between its folded position and an extended position as shown in FIG. 5. Preferably, the width 96 and width 98 are somewhat less than the diameter of a crown cap, so the number of folding tool blades mounted in the handle 20 could accordingly be limited.

Figure 7:
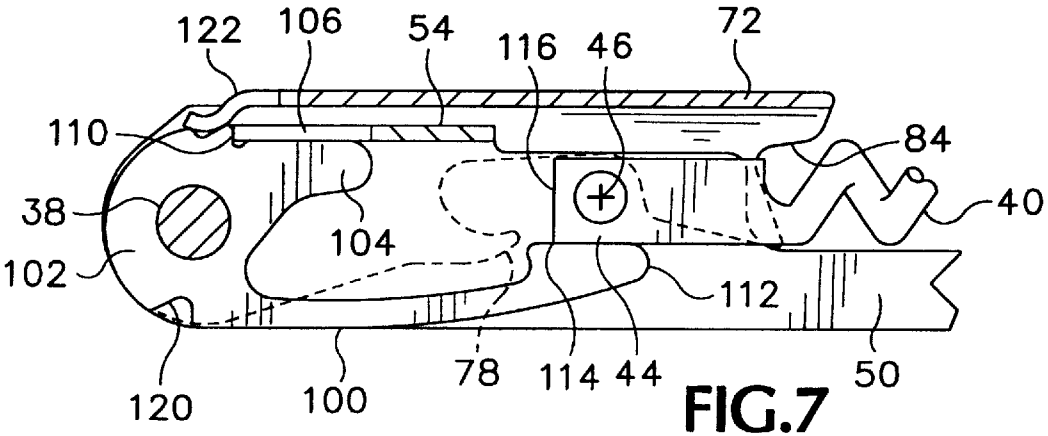
FIG. 7 is a section view, taken along line 7—7 in FIG. 4.

Referring to FIGS. 5, 6 and 7, a spring 100 includes a base portion 102 fitted snugly on the pivot shaft 38 and located within the cavity 24. The other tool blades associated with the outer end of the handle 20 keep the spring 100 closely alongside the first side 50 of the handle 20. A stabilizer arm 104 is located within the cavity 24 along a laterally-extending flange portion 106 of the back 54 of the handle 20, and a small finger 108 extends outwardly from the stabilizer arm 104 closely alongside a rear end 110 of the flange 106. The base 102 of the spring 100 is thus prevented from rotating about the pivot shaft 38. The location of part of the spring 100 aligned with an outer margin of the side 50 contributes to the comfort of the tool 16 in use of the pliers 18.

Extending forward from the portion of the base 102 furthest from the back 54 of the handle 20 is a cantilevered portion of the spring 100, with a free end 112 extending in a direction parallel with the length 48 of the handle 20. The free end 112 is located closely alongside and deflected slightly by the base 44 of the corkscrew 40 when the corkscrew 40 is in the folded position, as shown in FIG. 7, and thus is biased elastically toward the corner 114, acting to hold the corkscrew 40 in its folded position.

Referring to FIG. 6, as the corkscrew 40 is moved toward an extended position, the corner 114 forces the free end 112 of the spring 100 to move away from the back 54 of the handle 20 to permit the inner end 116 to move to rest against the free end 112 of the spring. Thereafter, some displacement of the free end 112 is required to move the corkscrew 40 from the position extending perpendicular to the length 48 as shown in FIG. 6. The spring 100 thus holds the corkscrew in a preferred position perpendicular to the handle 20 as the screw is turned into a cork during use. Once the corkscrew has engaged the cork, the corkscrew 40 can be moved about the pivot axis 46 as required during use of the tool, as will be explained presently.

The base portion 102 of the spring 100 includes an arcuate cam surface along the outer end of the handle 20, the cam surface including a detent notch 118 adjacent the finger 108, and a deeper stop notch 120 on the opposite side of the base 102.

As may be seen best in FIGS. 4, 6, and 7, a small finger-like latch spring 122 extends rearwardly and downwardly from the rear end of the back portion 72 of the brace 42. The spring 122 rides upon the cam surface of the base 102 of the spring 100 and rests in the detent notch 118 to keep the brace 42 in its folded position along the back 54 of the handle 20 as shown in FIG. 7. The spring latch 122 also enters the stop notch 120 when the brace 42 is in a fully-extended position as shown in FIG. 6, to prevent the brace 42 from rotating further with respect to the handle 20, during its use to open a can or to remove a crown cap from a bottle.

The flange 106 extends laterally inward from the first side 50, to which it is rigidly attached, and a cantilevered spring 124 is separated from the flange 106 by a slit 126 defined in the back 54, as seen best in FIG. 5. Because the spring 124 is separated from the flange 106, the other tool blades mounted on the pivot shaft 38 and stored in the first handle 20, including the fork 36, may be rotated about the pivot shaft 38 from their respective folded positions to their respective extended positions. The spring 124 acts on their bases to keep a selected blade extended in a manner which is well-known in folding multipurpose tools, without affecting the spring 100.

Figure 8:
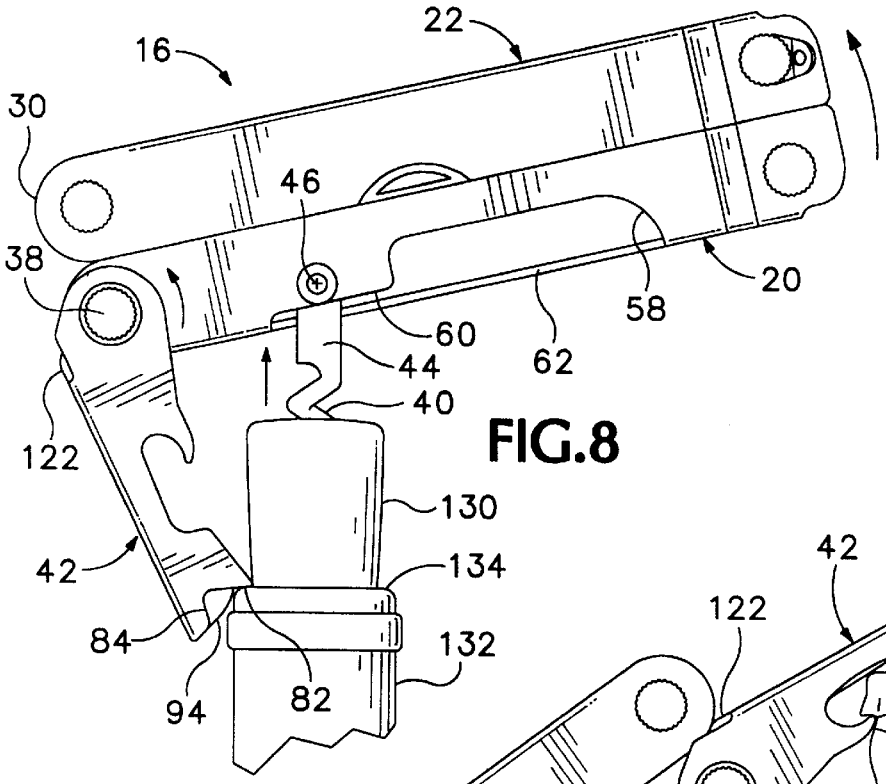
FIG. 8 is a side elevational view of the tool showing the use of the corkscrew to remove a cork from a bottle neck.

As shown in FIG. 8, the folding multipurpose tool of the present invention is used to remove a cork 130 from a bottle 132 in a manner generally similar to that used with well-known "waiter-type" corkscrews, with the difference that because of the location of the corkscrew 40 adjacent the first side 50 of the handle 20 only the single foot 82 is placed atop the lip 134 of the bottle neck 132. The rocker 94 then is located alongside and spaced slightly apart from the bottle neck 132, but not in contact with it. Since the foot 82 is aligned with the longitudinal axis 68 of the corkscrew 40, the brace 42 adequately supports the handle 20 so that the pivot shaft 38 acts as a fulcrum about which the handles 20 and 22 are rotated-together with respect to the brace 42 and the base 44 of the corkscrew 40 as the corkscrew 40 raises the cork 130. As the foot 82 of the brace 42 rests on the lip 134 of the bottle neck the friction resulting from pressure of the finger-like spring 122 against the cam surface on the base 102 of the spring 100 urges the brace 42 toward the cork as the handle 20 is raised to pull the cork 130 from the bottle neck 132.

Figure 9:
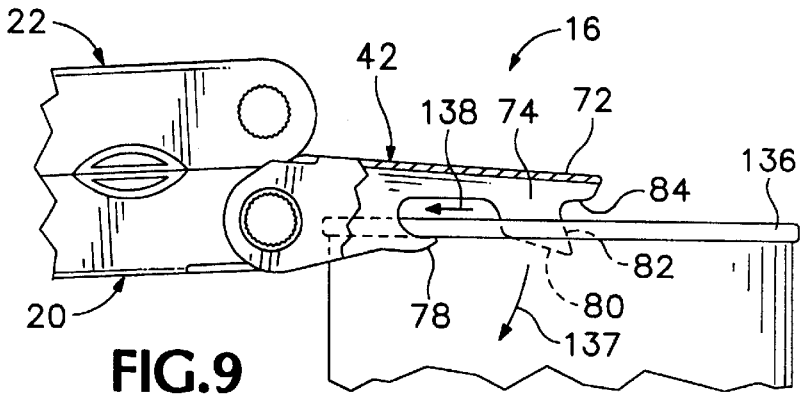
FIG. 9 is a partially cutaway view of a portion of the tool, showing the manner of use of the can opener.

To cut open a metal can, with the brace 42 in the fully-extended position shown in FIGS. 6 and 9, the hook 78 on the first side 74 of the brace is engaged with the underside of the crimped rim 136 of the can. Raising the handles 20 and 22 then causes the can opener blade 80 to pierce the top of the can on the inner side of the crimped rim 136, moving down as indicated by the arrow 137. The can opener blade 80 is then raised and the can opener is moved slightly in the direction indicated by the arrow 138. The top of the can is cut free from the rim 136 by repeating the same sort of cutting by short steps around the circumference of the can.

Figure 10:
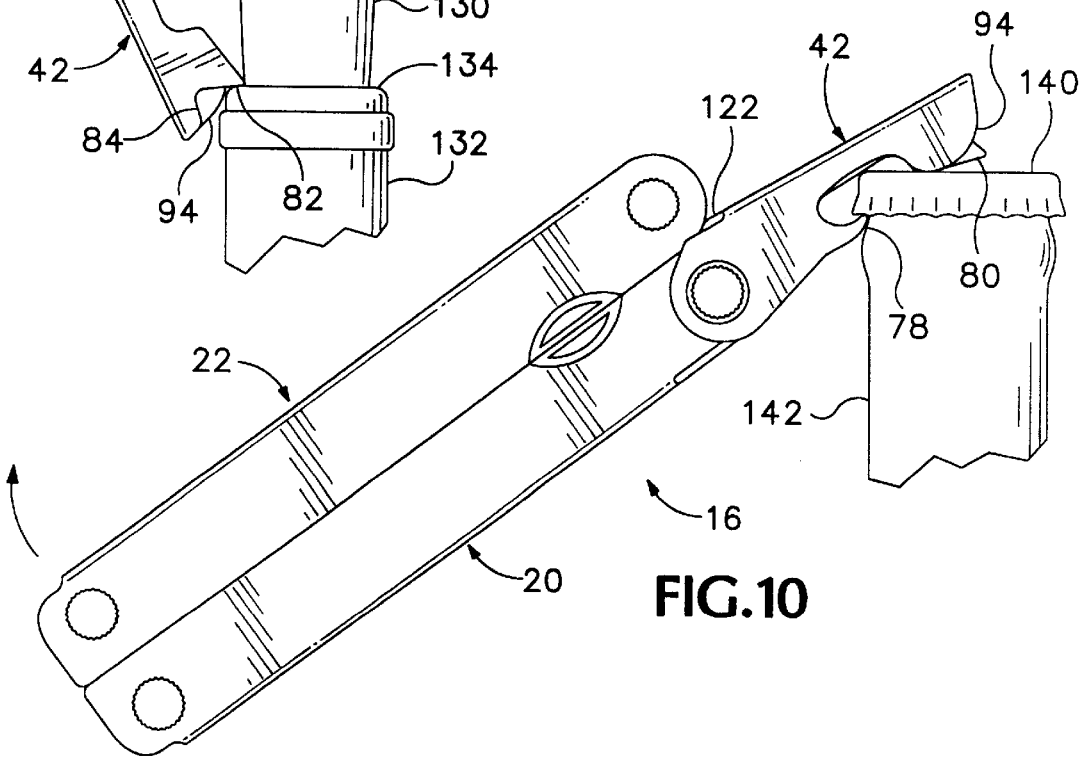
FIG. 10 is a side elevational view of the tool showing its use in removing a crown cap from a bottle.

With the brace 42 in the extended position as shown in FIGS. 6 and 10, the multipurpose folding tool 16 may also be used to remove a crown cap 140 from a bottle 142. Preferably, both of the hooks 78 are used to engage the edge of the crown cap at the same time, so that both the rocker 94 and the can opener blade 80 rest atop the crown cap 140, and the inner ends of the handles 20 and 22 are then raised, keeping the hooks 78 engaged to pull the crown cap 140 free from the bottle 142.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A multipurpose folding tool, comprising:

(a) an elongate handle having a length and including an elongate channel defined partially by a first side wall and a back of said elongate handle, said channel defining a blade-receiving cavity;

(b) at least one tool blade attached to said handle by a first pivot and movable with respect to said handle about said first pivot, between an extended position and a folded position in said cavity;

(c) a corkscrew having a base attached to said handle and movable with respect to said handle, about a second pivot spaced apart from said first pivot along said length of said handle, between respective folded and operative positions; and (d) a spring located in said cavity and having a base attached to said handle by said first pivot, said base being located alongside and parallel with said first side wall, said back defining a flange having a rear end, and a margin of said base of said spring extending along said flange and abutting against said rear end, said flange thereby preventing said base of said spring from rotating about said first pivot with respect to said first side wall, and said spring extending from said base thereof to said base of said corkscrew.

2. The multipurpose folding tool of claim 1 wherein said handle has a pair of opposite ends and wherein said first pivot is located adjacent one of said opposite ends.

3. The multipurpose folding tool of claim 1 wherein said base of said corkscrew has a flat side and a portion of said spring extends along said flat side and is biased elastically toward said flat side, thereby holding said corkscrew in said folded position.

4. A multipurpose folding tool, comprising:

(a) an elongate handle including an elongate channel and having a first side wall and a back, said handle defining a blade-receiving cavity and having a length;

(b) at least one tool blade attached to said handle and movable with respect to said handle about a first pivot, between an extended position and a folded position in said cavity;

(c) a corkscrew having a base attached to said handle and movable with respect to said handle, about a second pivot spaced apart from said first pivot along said length of said handle, between respective folded and operative positions; and (d) a spring located in said cavity and having a base attached to said handle adjacent said first pivot and alongside and parallel with said first side wall, said back defining a flange extending along a margin of said base of said spring, thereby preventing said base of said spring from rotating with respect to said first side wall, and said spring extending from said base thereof to said base of said corkscrew and wherein said back defines a spring biased toward said tool blade, said spring extending alongside said flange and being separated therefrom by a slit defined in said back.

5. The multipurpose folding tool of claim 1, further including a folding corkscrew brace having the form of a channel including a pair of sides and a back member, said folding corkscrew brace being attached to said handle by said first pivot and being movable with respect to said handle about said first pivot between an extended, bracing, position and a folded position wherein said brace extends along said back of said handle.

6. A multipurpose folding tool, comprising:

(a) an elongate handle including an elongate channel and having a first side wall and a back, said handle defining a blade-receiving cavity and having a length;

(b) at least one tool blade attached to said handle and movable with respect to said handle about a first pivot, between an extended position and a folded position in said cavity;

(c) a corkscrew having a base attached to said handle and movable with respect to said handle, about a second pivot spaced apart from said first pivot along said length of said handle, between respective folded and operative positions, said corkscrew having a longitudinal central axis defining an imaginary plane as said corkscrew moves about said second pivot, one of said sides of said corkscrew brace being located in said imaginary plane;

(d) a spring located in said cavity and having a base attached to said handle adjacent said first pivot and alongside and parallel with said first side wall, said back defining a flange extending along a margin of said base of said spring, thereby preventing said base of said spring from rotating with respect to said first side wall, and said spring extending from said base thereof to said base of said corkscrew; and (e) a folding corkscrew brace having the form of a channel including a pair of sides and a back member, said folding corkscrew brace being attached to said handle by said first pivot and being movable with respect to said handle about said first pivot between an extended, bracing, position and a folded position wherein said brace extends along said back of said handle.

7. A multipurpose folding tool, comprising:

(a) an elongate handle including an elongate channel and having a first side wall and a back, said handle defining a blade-receiving cavity and having a length;

(b) at least one tool blade attached to said handle and movable with respect to said handle about a first pivot, between an extended position and a folded position in said cavity;

(c) a corkscrew having a base attached to said handle and movable with respect to said handle, about a second pivot spaced apart from said first pivot along said length of said handle, between respective folded and operative positions;

(d) a spring located in said cavity and having a base attached to said handle adjacent said first pivot and alongside and parallel with said first side wall, said back defining a flange extending along a margin of said base of said spring, thereby preventing said base of said spring from rotating with respect to said first side wall, and said spring extending from said base thereof to said base of said corkscrew;

(e) a folding corkscrew brace having the form of a channel including a pair of sides and a back member, said folding corkscrew brace being attached to said handle by said first pivot and being movable with respect to said handle about said first pivot between an extended, bracing, position and a folded position wherein said brace extends along said back of said handle; and (f) a cam located adjacent to said first pivot, said corkscrew brace having a rear end and including a finger-like spring projecting rearwardly from said rear end and engaging said cam.

8. The multipurpose folding tool of claim 1, further including a folding bottle opener having the form of a channel including a pair of sides and a back member, said folding bottle opener being attached to said handle by said first pivot and being movable with respect to said handle about said first pivot, between an extended position and a folded position wherein said bottle opener extends along said back of said handle.

9. A multipurpose folding tool, comprising:

(a) an elongate handle including an elongate channel and having a first side wall and a back, said handle defining a blade-receiving cavity and having a length;

(b) at least one tool blade attached to said handle and movable with respect to said handle about a first pivot, between an extended position and a folded position in said cavity;

(c) a corkscrew having a base attached to said handle and movable with respect to said handle, about a second pivot spaced apart from said first pivot along said length of said handle, between respective folded and operative positions;

(d) a spring located in said cavity and having a base attached to said handle adjacent said first pivot and alongside and parallel with said first side wall, said back defining a flange extending along a margin of said base of said spring, thereby preventing said base of said spring from rotating with respect to said first side wall, and said spring extending from said base thereof to said base of said corkscrew;

(e) a folding bottle opener having the form of a channel including a pair of sides and a back member, said folding bottle opener being attached to said handle by said first pivot and being movable with respect to said handle about said first pivot, between an extended position and a folded position wherein said bottle opener extends along said back of said handle; and (f) a cam located adjacent to said first pivot, said bottle opener having a rear end and including a finger-like spring projecting rearwardly from said rear end and engaging said cam.

10. The multipurpose folding tool of claim 1, further including a folding can opener having the form of a channel including a side and a back member, said folding can opener being attached to said handle by said first pivot and being movable with respect to said handle about said first pivot, between an extended position and a folded position wherein said can opener extends along said back of said handle.

11. A multipurpose folding tool, comprising:

(a) an elongate handle including an elongate channel and having a first side wall and a back, said handle defining a blade-receiving cavity and having a length;

(b) at least one tool blade attached to said handle and movable with respect to said handle about a first pivot, between an extended position and a folded position in said cavity;

(c) a corkscrew having a base attached to said handle and movable with respect to said handle, about a second pivot spaced apart from said first pivot along said length of said handle, between respective folded and operative positions;

(d) a spring located in said cavity and having a base attached to said handle adjacent said first pivot and alongside and parallel with said first side wall, said back defining a flange extending along a margin of said base of said spring, thereby preventing said base of said spring from rotating with respect to said first side wall, and said spring extending from said base thereof to said base of said corkscrew;

(e) a folding can opener having the form of a channel including a side and a back member, said folding can opener being attached to said handle by said first pivot and being movable with respect to said handle about said first pivot, between an extended position and a folded position wherein said can opener extends along said back of said handle; and (f) a cam located adjacent to said first pivot, said can opener having a rear end and including a finger-like spring projecting rearwardly from said rear end and engaging said cam.

12. A combined bottle opener and can opener for use in combination with a handle of a hand tool, comprising:

(a) a channel-shaped member including a central back portion and a pair of apart-spaced side portions, said side portions defining a transverse pivot axis adjacent a rear end of said channel-shaped member;

(b) each of said side portions including a forwardly-open hook located forward from said transverse pivot axis;

(c) a first one of said side portions including a can opener blade having a substantially straight cutting edge portion located spaced forwardly apart from said hook thereof, whereby said first one of said side portions functions as a can opener with said hook engaging a rim of a can and said can opener blade cutting a top of said can along said rim; and (d) a second one of said side portions including a convexly arcuate rocker located spaced forwardly apart from said hook thereof and aligned laterally opposite said cutting edge portion of said can opener blade.

13. A combined bottle opener and can opener for use in combination with a handle of a hand tool, comprising:

(a) a channel-shaped member including a central back portion and a pair of apart-spaced side portions, said side portions defining a transverse pivot axis adjacent a rear end of said channel-shaped member, and said channel-shaped member including a finger-like spring projecting rearwardly and downwardly from said back portion in position to engage a cam associated with a handle of a hand tool to hold said combined bottle opener and can opener in a selected position of rotation about said pivot axis with respect to said handle;

(b) each of said side portions including a forwardly-open hook located forward from said transverse pivot axis;

(c) a first one of said side portions including a can opener blade located spaced forwardly apart from said hook thereof, whereby said first one of said side portions functions as a can opener with said hook engaging a rim of a can and said can opener blade cutting a top of said can along said rim; and (d) a second one of said side portions including a rocker located spaced forwardly apart from said hook thereof.

14. The combined bottle opener and can opener of claim 12 wherein said can opener blade includes an arcuate rear end.

15. The combined bottle opener and can opener of claim 12 wherein said can opener blade includes a piercing tip.

16. A multipurpose folding tool, comprising:

(a) a handle having a length and including an elongate channel including a back and respective first and second sides, said back extending through a majority of said length and said first side being interconnected with said back along a longitudinally-extending angle portion of said handle, said first side and said back defining an elongate opening extending along said angle portion of said handle;

(b) a corkscrew having a base, said base being attached to said first side by a first pivot, and said corkscrew being movable through an angle with respect to said first side about a first pivot axis, between a folded position and an extended position, a portion of said corkscrew extending through said opening and being located inside said handle when said corkscrew is in said folded position; and (c) a brace attached to said handle by a second pivot defining a second pivot axis spaced apart from said first pivot axis, said brace being rotatable about said second pivot axis, between a folded position and an extended position, and said brace including a foot spaced apart from said second pivot axis and located closely alongside said first side of said handle when said brace is in said folded position.

17. A multipurpose folding tool, comprising:

(a) a handle in the form of an elongate channel including a back and respective first and second sides, said first side being interconnected with said back along a longitudinally-extending angle portion of said handle, said side and said back defining an elongate opening extending along said angle portion of said handle;

(b) a corkscrew having a base, said base being attached to said first side by a first pivot, and said corkscrew being movable through an angle with respect to said first side about a first pivot axis, between a folded position and an extended position, a portion of said corkscrew extending through said opening and being located inside said handle when said corkscrew is in said folded position;

(c) a brace attached to said handle by a second pivot defining a second pivot axis spaced apart from said first pivot axis, said brace being rotatable about said second pivot axis, between a folded position and an extended position, and said brace including a foot spaced apart from said second pivot axis and located closely alongside said first side of said handle when said brace is in said folded position; and (d) a cam located within said handle adjacent said second pivot axis, and wherein said brace has a rear end and includes a latch spring extending from said rear end and resting in contact with said cam.

18. The tool of claim 17 wherein said cam includes a detent and said latch spring rests on said detent when said brace is in said closed position.

19. The tool of claim 17 wherein said brace includes a bottle cap remover including a pair of hooks and a pair of rockers, and wherein said cam includes a limit stop and said latch spring rests against said limit stop when said brace is in said extended position.

20. The tool of claim 17 wherein said brace includes a can opener including a hook and a can opener blade and wherein said cam includes a limit stop and said latch spring rests against said limit stop when said brace is in said extended position.

21. The folding tool of claim 17 wherein said second pivot axis is defined by a tool pivot shaft mounted in said handle, and wherein said cam is mounted on said tool pivot shaft.

22. The folding tool of claim 20 wherein said cam is a part of a base of a spring extending alongside said first side of said handle and in contact with said base of said corkscrew.

23. A multipurpose folding tool, comprising:

(a) a handle in the form of an elongate channel including a back and respective first and second sides, said first side being interconnected with said back along a longitudinally-extending angle portion of said handle, said first side and said back defining an elongate opening extending along said angle portion of said handle;

(b) a corkscrew having a base, said base being attached to said first side by a first pivot, and said corkscrew being movable through an angle with respect to said first side about a first pivot axis, between a folded position and an extended position, a portion of said corkscrew extending through said opening and being located inside said handle when said corkscrew is in said folded position, and said corkscrew having a central longitudinal axis located outside said handle; and (c) a brace attached to said handle by a second pivot defining a second pivot axis spaced apart from said first pivot axis, said brace being rotatable about said second pivot axis, between a folded position and an extended position, and said brace including a foot spaced apart from said second pivot axis and located closely alongside said first side of said handle when said brace is in said folded position.

24. The folding tool of claim 23 wherein said foot is located in a plane defined by said central axis as said corkscrew moves about said first pivot axis.

25. The folding tool of claim 16 wherein said corkscrew has a tip located within said handle when said corkscrew is in said folded position.

* * * * *